US008797035B2

(12) United States Patent
Bittar et al.

(10) Patent No.: US 8,797,035 B2
(45) Date of Patent: Aug. 5, 2014

(54) APPARATUS AND METHODS FOR MONITORING A CORE DURING CORING OPERATIONS

(71) Applicant: Halliburton Energy Services, Inc., Houston, TX (US)

(72) Inventors: Michael S. Bittar, Houston, TX (US); Gary E. Weaver, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 22 days.

(21) Appl. No.: 13/659,273

(22) Filed: Oct. 24, 2012

(65) Prior Publication Data

US 2013/0113488 A1 May 9, 2013

(30) Foreign Application Priority Data

Nov. 9, 2011 (WO) ..... PCT/US2011/059950

(51) Int. Cl.

| | |
|---|---|
| ***G01V 3/00*** | (2006.01) |
| ***E21B 47/10*** | (2012.01) |
| ***E21B 25/00*** | (2006.01) |

(52) U.S. Cl.

CPC ..... *E21B 47/102* (2013.01); *E21B 25/00* (2013.01)

USPC ..... 324/333; 702/10; 73/152.02

(58) Field of Classification Search

CPC ..... G01V 3/12; G01V 3/18; G01V 3/28; G01V 3/30; E21B 47/122; E21B 34/06; G01N 24/081; G01N 33/24

USPC ..... 324/333, 323, 338, 377; 702/10; 175/73

See application file for complete search history.

(56) References Cited

U.S. PATENT DOCUMENTS 2,921,253 A * 1/1960 Liben ..... 324/355
3,479,001 A 11/1969 Dower (Continued)

FOREIGN PATENT DOCUMENTS

CN 101037941 A 9/2007
WO 2009062716 A2 5/2009

(Continued)

OTHER PUBLICATIONS

International Search Report with Written Opinion issued Nov. 30, 2009 for International Patent Application No. PCT/US09/059534, 8 pages.

International Search Report with Written Opinion issued Nov. 25, 2009 for International Patent Application No. PCT/US09/059541, 8 pages.

(Continued)

*Primary Examiner* — Huy Q Phan
*Assistant Examiner* — Giovanni Astacio-Oquendo
(74) *Attorney, Agent, or Firm* — Smith IP Services, P.C.

(57) ABSTRACT

One method of monitoring a formation core during coring operations can include measuring resistivities of a formation internal and external to a core barrel assembly, comparing the resistivities of the formation internal and external to the core barrel assembly, and determining a displacement of the core into the core barrel assembly, based at least in part on the comparing, while the core is being cut. A formation core analysis system can include multiple longitudinally spaced apart sets of transmitters and receivers which measure resistivity of a core while the core displaces into a core barrel assembly, and multiple longitudinally spaced apart sets of transmitters and receivers which measure resistivity of a formation external to the core barrel assembly while a coring bit penetrates the formation. A speed of displacement of the core may be indicated by differences in time between measurements taken via the different sets as the core displaces.

33 Claims, 6 Drawing Sheets

(56) References Cited

U.S. PATENT DOCUMENTS

| | | | | |
|---|---|---|---|---|
| 3,605,920 | A * | 9/1971 | Woodward | 175/46 |
| 4,393,350 | A | 7/1983 | Hansen et al. | |
| 4,492,275 | A | 1/1985 | Campbell et al. | |
| 4,499,955 | A | 2/1985 | Campbell et al. | |
| 4,578,675 | A | 3/1986 | MacLeod | |
| 4,596,143 | A | 6/1986 | Norel | |
| 4,601,354 | A | 7/1986 | Campbell et al. | |
| 4,940,943 | A | 7/1990 | Bartel et al. | |
| 5,095,273 | A | 3/1992 | Kennedy et al. | |
| 5,160,925 | A | 11/1992 | Dailey et al. | |
| 5,235,285 | A | 8/1993 | Clark et al. | |
| 5,339,036 | A | 8/1994 | Clark et al. | |
| 5,501,285 | A | 3/1996 | Lamine et al. | |
| 5,508,616 | A | 4/1996 | Sato et al. | |
| 5,568,838 | A | 10/1996 | Struthers et al. | |
| 5,726,951 | A | 3/1998 | Birchak et al. | |
| 5,984,023 | A | 11/1999 | Sharma et al. | |
| 6,006,844 | A | 12/1999 | Van Puymbroeck et al. | |
| 6,176,323 | B1 | 1/2001 | Weirich et al. | |
| 6,181,138 | B1 | 1/2001 | Hagiwara et al. | |
| 6,220,371 | B1 | 4/2001 | Sharma et al. | |
| 6,304,086 | B1 | 10/2001 | Minerbo et al. | |
| 6,374,925 | B1 | 4/2002 | Elkins et al. | |
| 6,457,538 | B1 | 10/2002 | Pittard et al. | |
| 6,480,118 | B1 | 11/2002 | Rao | |
| 6,710,601 | B2 | 3/2004 | Rosthal et al. | |
| 6,778,127 | B2 | 8/2004 | Stolarczyk et al. | |
| 6,788,066 | B2 | 9/2004 | Wisler et al. | |
| 6,791,469 | B1 | 9/2004 | Rao et al. | |
| 6,819,110 | B2 | 11/2004 | Omeragic et al. | |
| 6,958,610 | B2 | 10/2005 | Gianzero | |
| 7,046,165 | B2 | 5/2006 | Beique et al. | |
| 7,138,897 | B2 * | 11/2006 | Minerbo et al. | 336/90 |
| 7,168,508 | B2 | 1/2007 | Goldberg et al. | |
| 7,265,649 | B1 * | 9/2007 | Hall et al. | 336/84 M |
| 7,293,613 | B2 | 11/2007 | Goldberg et al. | |
| 7,350,568 | B2 | 4/2008 | Mandal et al. | |
| 7,414,406 | B2 | 8/2008 | Banning et al. | |
| 7,436,184 | B2 | 10/2008 | Moore | |
| 7,500,388 | B2 | 3/2009 | Fujisawa et al. | |
| 7,612,565 | B2 | 11/2009 | Seydoux et al. | |
| 7,659,722 | B2 | 2/2010 | Bittar | |
| 7,665,542 | B2 * | 2/2010 | Stockton | 175/44 |
| 7,748,265 | B2 | 7/2010 | Reid et al. | |
| 8,072,221 | B2 * | 12/2011 | Snyder et al. | 324/339 |
| 2001/0046811 | A1 * | 11/2001 | Fleury et al. | 439/610 |
| 2001/0050559 | A1 * | 12/2001 | Wisler et al. | 324/377 |
| 2002/0169559 | A1 | 11/2002 | Onyia et al. | |
| 2003/0168257 | A1 | 9/2003 | Aldred et al. | |
| 2004/0183538 | A1 | 9/2004 | Hanstein et al. | |
| 2005/0252286 | A1 | 11/2005 | Ibrahim et al. | |
| 2006/0017443 | A1 | 1/2006 | Folberth et al. | |
| 2006/0244455 | A1 | 11/2006 | Bittar | |
| 2007/0168056 | A1 | 7/2007 | Shayegi et al. | |
| 2007/0256832 | A1 | 11/2007 | Hagiwara et al. | |
| 2007/0285274 | A1 | 12/2007 | Esmersoy | |
| 2008/0078580 | A1 | 4/2008 | Bittar | |
| 2008/0258733 | A1 | 10/2008 | Bittar | |
| 2008/0297161 | A1 | 12/2008 | Gorek | |
| 2009/0105955 | A1 | 4/2009 | Castillo et al. | |
| 2009/0139768 | A1 | 6/2009 | Castillo | |
| 2009/0150076 | A1 | 6/2009 | Taherian et al. | |
| 2009/0159335 | A1 | 6/2009 | Cravatte | |
| 2009/0166088 | A1 | 7/2009 | Jeffryes et al. | |
| 2009/0224764 | A1 * | 9/2009 | Bittar | 324/338 |
| 2009/0230968 | A1 | 9/2009 | Bittar et al. | |
| 2010/0000792 | A1 * | 1/2010 | Alberty | 175/50 |
| 2010/0179762 | A1 | 7/2010 | Tabarovsky et al. | |
| 2011/0180327 | A1 | 7/2011 | Bittar et al. | |
| 2012/0081121 | A1 | 4/2012 | Maurer et al. | |
| 2013/0113487 | A1 | 5/2013 | Bittar et al. | |

FOREIGN PATENT DOCUMENTS

| | | | |
|---|---|---|---|
| WO | 2010005902 | A2 | 1/2010 |
| WO | 2010050840 | A1 | 5/2010 |
| WO | 2011004069 | A1 | 1/2011 |
| WO | 2011043851 | A1 | 4/2011 |
| WO | 2011090480 | A1 | 7/2011 |

OTHER PUBLICATIONS

International Search Report with Written Opinion issued Nov. 25, 2009 for International Patent Application No. PCT/US09/059545, 8 pages.

International Search Report with Written Opinion issued Feb. 1, 2011 for International Patent Application No. PCT/US10/036851, 9 pages.

Rigzone; "Featured Employer: At Balance", online article, dated 1999-2011, 2 pages.

Schlumberger; "Managed Pressure Drilling & Underbalanced Drilling", online article, dated 2011, 2 pages.

Schlumberger, Don Reitsma; "Technical Paper: An Automated System for Accurate and Rapid Detection of Drilling Anomalies", technical paper, No. 140255, IADC Society, dated 2011, 2 pages.

ERC Equipoise; "ERC Equipoise Limited", company information, retrieval date Sep. 9, 2011, 9 pages.

Halliburton; "The Key to Drilling Optimization and Managed Pressure Drilling", Informational article, dated Oct. 2007, 8 pages.

Halliburton; "GeoBalance Optimized Pressure Drilling Services", H06382, dated Jan. 2009, 12 pages.

Search Report issued Aug. 30, 2012 for International Application Serial No. PCT/US11/59950, 5 pages.

Written Opinion issued Aug. 30, 2012 for International Application Serial No. PCT/US11/59950, 5 pages.

Office Action issued Dec. 18, 2013 for U.S. Appl. No. 13/659,250, 30 pages.

Office Action issued Jan. 16, 2014 for U.S. Appl. No. 13/201,031, 20 pages.

Halliburton; "New InSite Generation Resistivity Sensor Combines GeosteeringlFormation Evaluation While Drillinf to Optimize Wellbore Placement in Complex, Deviated and Horizontal Wells", Fuel from Knowledge Central article, dated Jul. 2007, 10 pages.

PBORE; "History", company brochure, dated Mar. 13, 1996, 6 pages.

SPE International; "Real-Time Basin Modeling: Improving GeoPressure and Earth-Stress Predictions", SPE 96464, dated Sep. 6-9, 2005, 6 pages.

SPE International; "New Data Transmission Standard Facilities Synchronous Remote Modeling and Surveillance via the Internet" SPE 99466, dated Apr. 11-13, 2006, 9 pages.

SPE International & IADC; "Novel Approach for Estimating Pore Fluid Pressures Ahead of the Drill Bit", SPE/IADC 104606, dated Feb. 20-22, 2007, 13 pages.

Halliburton; "StressCheck Software", Landmark article H04872, dated Aug. 2006, 4 pages.

Halliburton; "StressCheck Software", Landmark article H04972, dated Aug. 2006, 4 pages.

International Search Report with Written Opinion issued Aug. 30, 2012 for PCT Patent Application No. PCT/US11/059950, 10 pages.

Office Action issued Mar. 10, 2014 for U.S. Appl. No. 13/659,250, 39 pages.

Office Action issued May 15, 2014 for U.S. Appl. No. 13/144,321, 23 pages.

Akinbinu, V.A.; "Prediction of fracture Gradient from Formation Pressures and Depth Using Correlation and Stepwise Multiple Regression Techniques", Journal of Petroleum Science and Engineering 72, pp. 10-17, dated Feb. 16, 2010, 8 pages.

International Search Report with Written Opinion issued Dec. 3, 2010 for PCT Patent Application PCT/US10/051384, 8 pages.

International Search Report with Written Opinion issued Aug. 30, 2012 for PCT Patent Application PCT/US11/059947, 9 pages.

Zoeller, W.A.; "Pore Pressure Detection From the MWD Gamma Ray", SPE 12166, dated Oct. 5-8, 1983, 12 pages.

* cited by examiner

APPARATUS AND METHODS FOR MONITORING A CORE DURING CORING OPERATIONS

CROSS-REFERENCE TO RELATED APPLICATION

This application claims the benefit under 35 USC §119 of the filing date of International Application Serial No. PCT/US11/59950, filed 9 Nov. 2011. The entire disclosure of this prior application is incorporated herein by this reference.

BACKGROUND

This disclosure relates generally to equipment utilized and operations performed in conjunction with a subterranean well and, in one example described below, more particularly provides an apparatus and method for monitoring a core while the core is being cut.

The sampling of earth formations by coring operations can provide valuable insights into the characteristics of those formations. However, it is sometimes difficult to determine whether or how fast a core is being cut, whether the core is displacing properly into a core barrel assembly, the exact depth at which the core was cut, etc. It will, therefore, be readily appreciated that improvements are continually needed in the art of monitoring core cutting operations.

DETAILED DESCRIPTION

Figure 1:
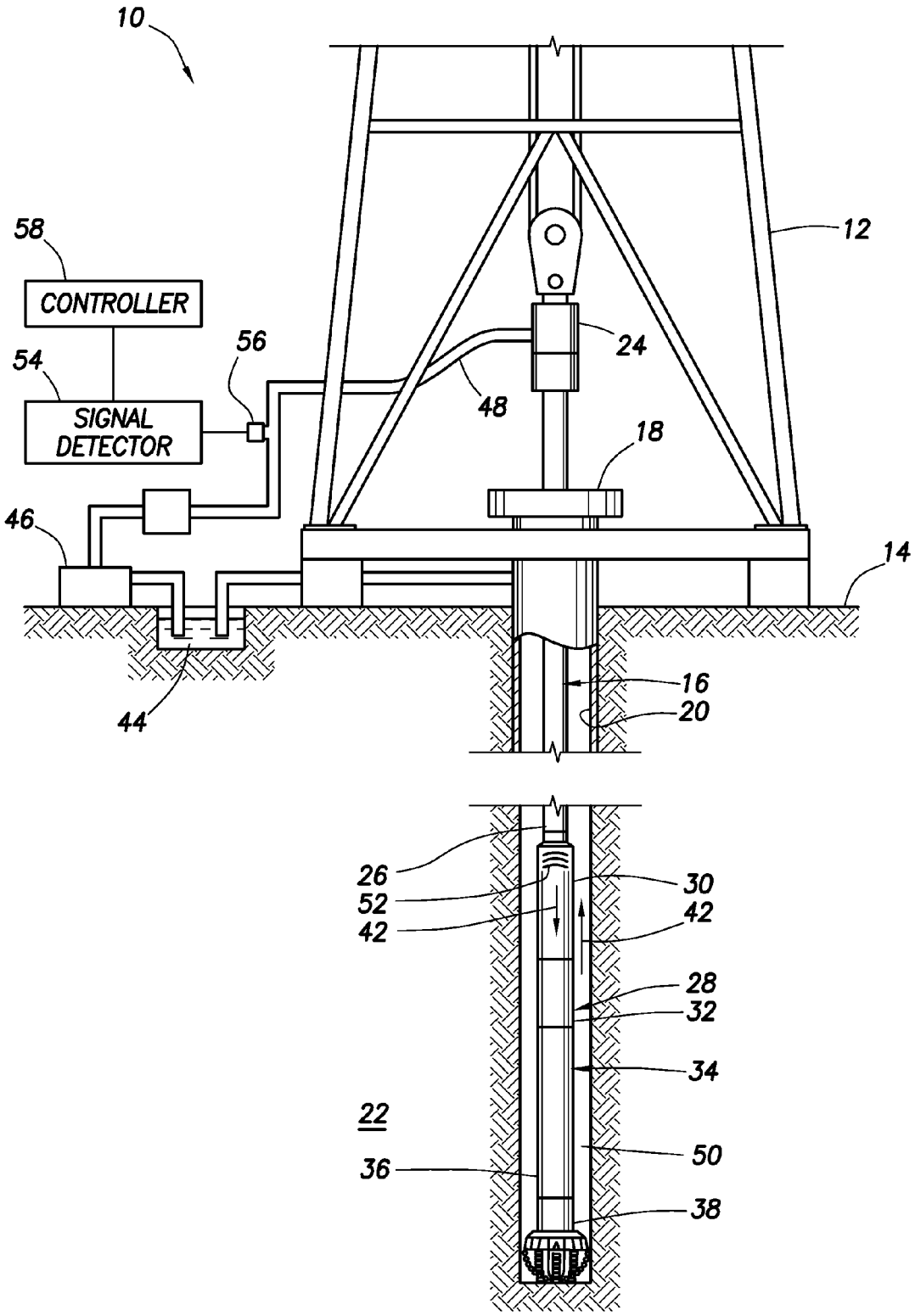
FIG. 1 is a representative cross-sectional view of a well system and associated method which can embody principles of this disclosure.

Representatively illustrated in FIG. 1 is an example of a well system 10 and associated method which can embody principles of this disclosure. However, it should be understood that the scope of this disclosure is not limited at all to the details of the well system 10 and method described herein and/or depicted in the drawings, since a wide variety of different well systems and methods can incorporate the principles of this disclosure.

In the FIG. 1 example, a drilling derrick 12 is located at or near the earth's surface 14, for supporting a drill string 16. The drill string 16 extends through a rotary table 18 and into a borehole 20 that is being drilled through an earth formation 22. In other examples, the derrick 12 may not be used, the surface 14 could be a sea floor or mudline, etc.

The drill string 16 may include a kelly 24 at its upper end, with drill pipe 26 coupled to the kelly 24. In other examples, a top drive or coiled tubing drilling rig could be used. Thus, it will be appreciated that the scope of this disclosure is not limited to any particular type of drilling equipment, or to any particular location of the drilling equipment.

A bottom hole assembly 28 (BHA) is coupled to a distal end of the drill pipe 26. The BHA 28 may include drill collars 30, a telemetry module 32 and a formation core analysis system 34. The core analysis system 34 can include a core barrel assembly 36 and a coring bit 38.

In operation, the kelly 24, the drill pipe 26 and the BHA 28 may be rotated by the rotary table 18. In other examples, a downhole motor (such as a positive displacement motor or a turbine) may be used to rotate the bit 38.

Weight applied through the drill collars 30 to the coring bit 38 causes the bit to drill through the formation 22 while generating a formation core 40 (see FIG. 2) that enters into the core barrel assembly 36. The core 40 is stored in the receptacle 36, and may be retrieved from the borehole 20 for inspection at the surface 14.

During this coring operation, drilling fluid 42 (commonly referred to as "drilling mud") may be pumped from a mud pit 44 at the surface 14 by a pump 46, so that the drilling fluid flows through a standpipe 48, the kelly 24, through drill string 16, and to the coring bit 38. The drilling fluid 42 is discharged from the coring bit 38 and functions to cool and lubricate coring bit, and to carry away earth cuttings made by the bit.

After flowing through the coring bit 38, the drilling fluid 42 flows back to the surface 14 through an annulus 50 between the drill string 16 and the borehole 20. The drilling fluid 42 is returned to the mud pit 44 for filtering and conditioning.

In this example, the circulating column of drilling fluid 42 flowing through the drill string 16 may also function as a medium for transmitting pressure signals 52 carrying information from telemetry module tool 32 to the surface 14. A pressure signal 52 travelling in the column of drilling fluid 42 may be detected at the surface 14 by a signal detector 54 employing a suitable pressure sensor 56.

The pressure signals 52 may be encoded binary representations of measurement data indicative of downhole coring parameters discussed more fully below. The detected signals 52 may be decoded by a surface controller 58.

The surface controller 58 may be located proximate to or remote from the derrick 12. In one example, the controller 58 may be incorporated as part of a logging unit.

In other examples, the controller 58 (and/or any other elements of the core analysis system 34) may be positioned at a subsea location, in the wellbore 20, as part of the BHA 28, or at any other location. The scope of this disclosure is not limited to any particular location of elements of the system 34.

Alternatively, other telemetry techniques, such as electromagnetic and/or acoustic techniques, may be utilized. In one example, hard wired drill pipe (e.g., the drill pipe 26 having lines extending in a wall thereof) may be used to communicate between the surface 14 and the BHA 28. In other examples, combinations of various communication techniques may be used (e.g., short hop acoustic or electromagnetic telemetry with long hop electrical or optical communication, etc.).

Figure 2:
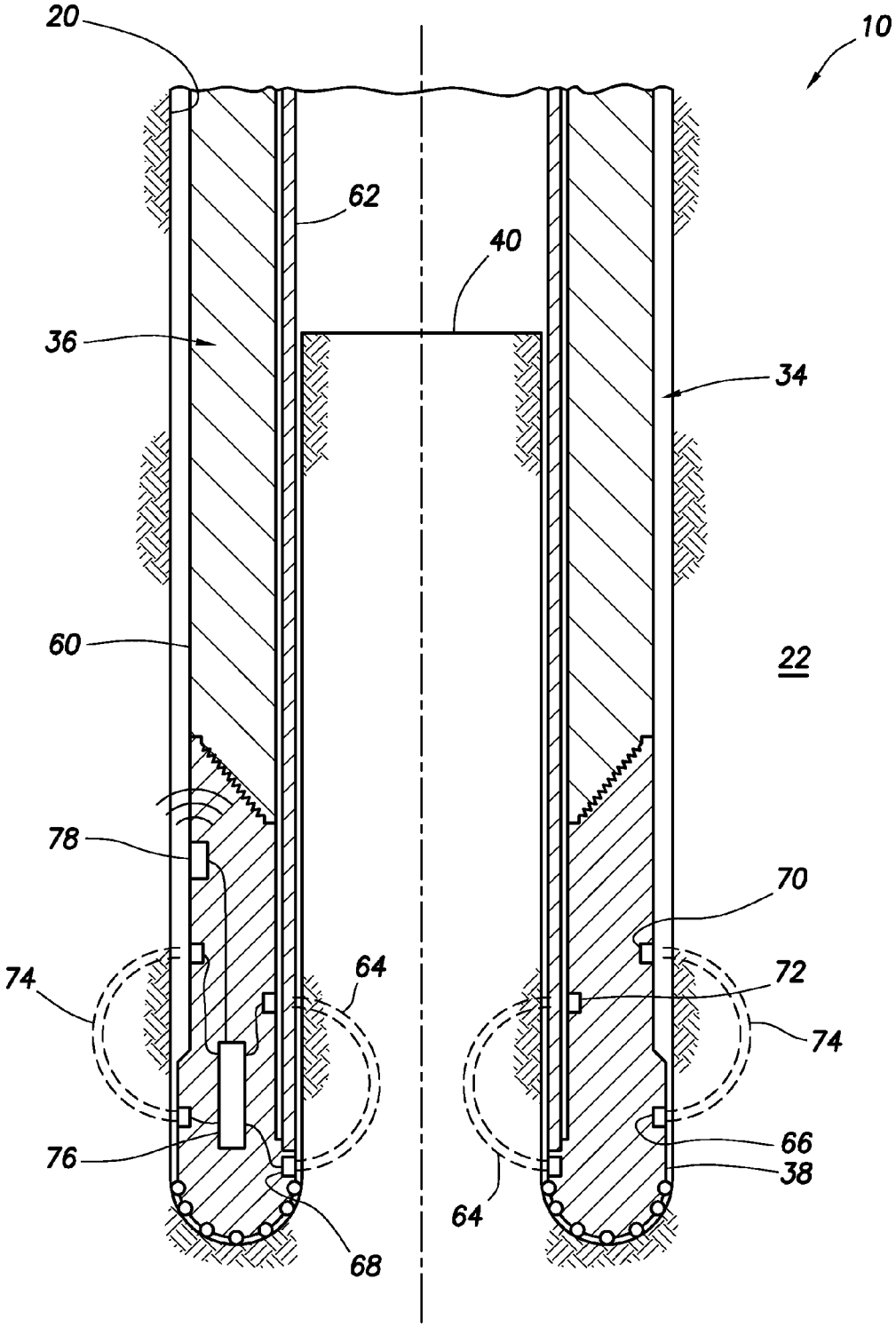
FIG. 2 is a representative cross-sectional view of a formation core analysis system which can embody principles of this disclosure, and which may be used in the well system of FIG. 1.

Referring additionally now to FIG. 2, a more detailed example of the core analysis system 34 is representatively illustrated. In this example, the core barrel assembly 36 includes an outer barrel 60 and a inner barrel 62 mounted substantially concentrically inside the outer barrel.

The coring bit 38 is attached to the distal end of the outer barrel 60. Bearings and seals (not shown) can be provided to allow the outer barrel 60 to rotate relative to the formation 22 during the coring operation, while the inner barrel 62 remains substantially non-rotating with respect to the formation. Such bearing and seal arrangements are known in the art, and so are not further described here.

In the FIG. 2 example, the inner barrel 62 is constructed of a non-metallic material, for example, a fiber reinforced resin material (e.g., fiber glass, etc.). This construction allows electromagnetic waves 64 to propagate through the inner barrel 62. In other examples, the inner barrel 62 could be made of other types or combinations of materials.

Electromagnetic wave receivers 66, 68 are located at external and internal surfaces, respectively, of the coring bit 38. Receiver 66 receives electromagnetic waves transmitted from an electromagnetic wave transmitter 70, and receiver 68 receives electromagnetic waves 74 transmitted from an electromagnetic wave transmitter 72. The receivers 66, 68 measure characteristics (e.g., voltage, current) indicative of resistivity of the formation 22 and the core 40, respectively.

The transmitters 70 and 72 can each comprise a wire loop antenna transmitting signals in, for example, a range of approximately 0.1 MHz to 5 MHz. Other ranges and other types of antennas may be used, as desired.

Electronics and software and/or firmware in a controller 76 can process the signals received by each receiver 66, 68 to determine an amplitude and phase of each received electromagnetic signal relative to each respective transmitted electromagnetic signal. The amplitude and phase may be related to the resistivity of the respective formation 22 and core 40 section that each signal traversed.

In one example, the receivers 66, 68 can each comprise a loop antenna similar to that of the transmitters 70 and 72. Such loop antenna receivers can measure a bulk resistivity of material traversed by the signals. However, other types of antennas or receivers may be used in keeping with the scope of this disclosure.

In another example, more localized resistivity may be detected with the use of receivers comprising a magnetic core surrounded by a wire coil. An axis of the magnetic core and wire coil can be oriented in different directions to measure different components of the electromagnetic signal.

Multiple receivers may be located around the inner and outer circumferences of the coring bit 38. As the coring bit 38 rotates relative to the formation 22 and the core 40, the transmitters 70, 72 and receivers 66, 68 also rotate, and finer detail may be observed of the resistivities in the formation and the core. The rotational data may provide for the generation of a resistivity map, or three-dimensional image, of the core 40 and surrounding formation 22.

In one method, the movement of the core 40 into the inner barrel 62 may be confirmed by comparing the measured resistivity of the core to the measured resistivity of the formation 22 over time. Assuming the formation 22 resistivity is substantially the same over the lateral distance from inside the inner barrel 62 to the formation wall external to the core barrel assembly 36, the resistivity measured at both locations should be approximately the same.

Fluid in the inner barrel 62, prior to entry of the core 40, will typically have a different resistivity than that of the formation 22. When the controller 76 senses substantially the same resistivity measurements by the receivers 66, 68, it may be programmed to transmit a signal, for example, a short-hop signal may be transmitted from a telemetry transmitter 78 to the telemetry module 32 (see FIG. 1) for retransmission to the surface 14, indicating that the core 40 has displaced into the inner barrel 62.

The short-hop signal may be an RF signal, an acoustic signal, or any other suitable type of signal. Alternatively, signals can be transmitted directly to the surface via hard wired drill pipe 26, etc. Any manner of transmitting signals may be used in keeping with the scope of this disclosure.

The transmitted data may contain raw resistivity measurements, measurements of parameters from which resistivity is derived, and data from other sensors (not shown) that may be connected to the controller 76. For example, the controller 76 may include or otherwise be connected to a temperature sensor and/or accelerometers to measure downhole temperature and drilling dynamics.

Figure 3:
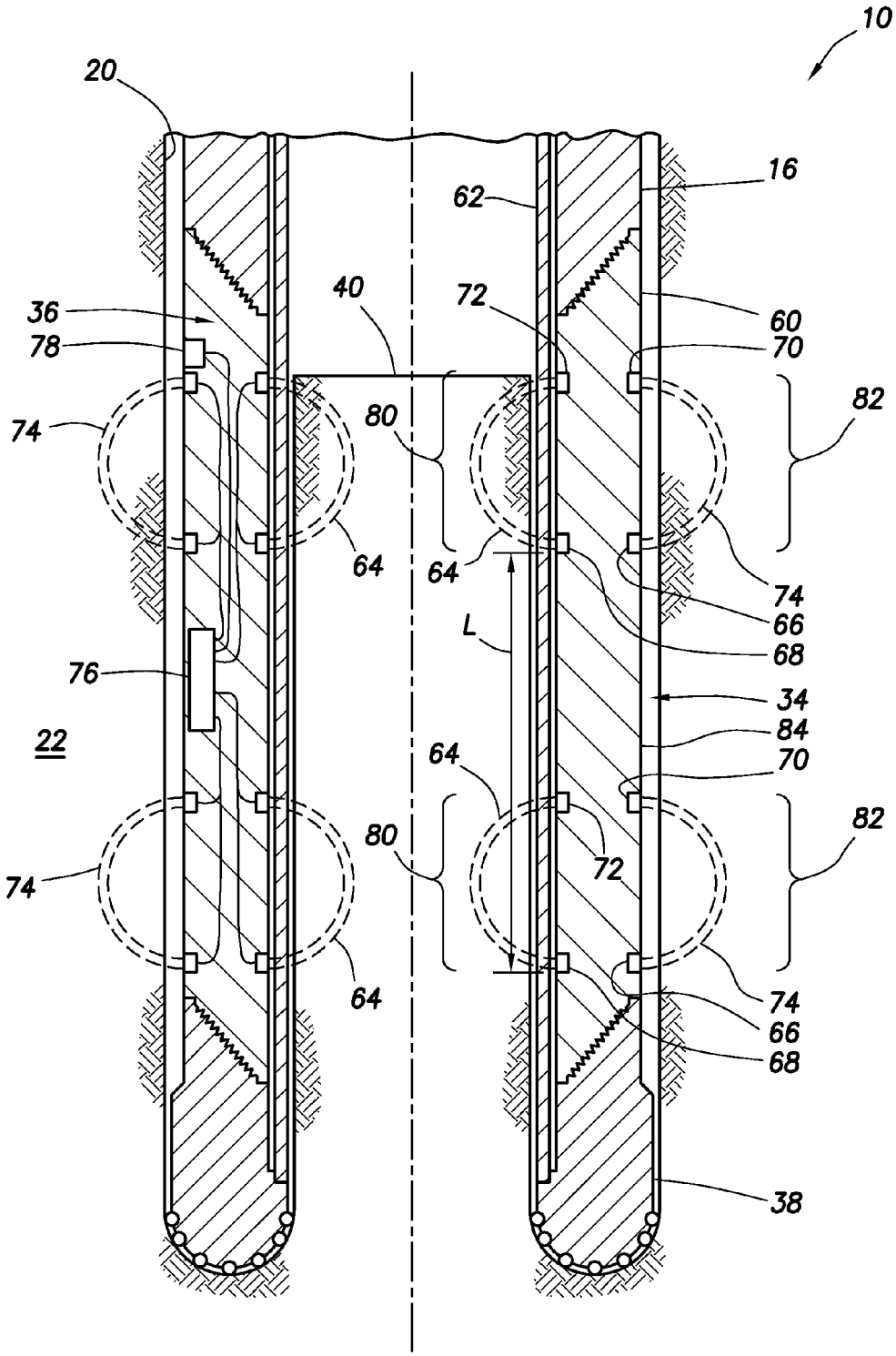
FIG. 3 is a representative cross-sectional view of another configuration of the formation core analysis system.

Referring additionally now to FIG. 3, another configuration of the core analysis system 34 is representatively illustrated. In this configuration, multiple longitudinally spaced apart sets 80, 82 of transmitters 70, 72 and receivers 66, 68 are positioned in an instrumented section 84 of the outer barrel 60.

The sets 80 each comprise one of the receivers 68 and one of the transmitters 72 for measuring the resistivity of the core 40 at longitudinally spaced apart locations, and the sets 82 each comprise one of the receivers 66 and one of the transmitters 70 for measuring the resistivity of the formation 22 surrounding the core. In other examples, other numbers of transmitters and/or receivers may be used in the sets 80, 82, other numbers of sets may be used in the instrumented section 84, other numbers of instrumented sections may be used in the outer barrel 60, etc. The scope of this disclosure is not limited to any particular numbers of elements of the core analysis system 34.

The controller 76, in this example, has electronic circuitry, a processor, memory and instructions stored therein to acquire the resistivity measurements. The controller 76 may have suitable instructions for analyzing the resistivity measurements and producing raw data and/or status flags. As mentioned above, comparisons of the resistivity measurements from the formation 22 and the core 40 may be used as an indicator for whether the core is moving into the inner barrel 62 as the coring bit 38 is penetrating the formation.

In the example depicted in FIG. 3, a single controller 76 is connected to all of the sets 80, 82 of receivers 66, 68 and transmitters 70, 72. However, in other examples, multiple controllers 76 and/or multiple transmitters 78 may be used. The scope of this disclosure is not limited to any particular number or arrangement of elements of the core analysis system 34.

By providing longitudinally spaced apart resistivity measurements of the core 40, the progress of the core during the coring operation can be confirmed, including whether the core is displacing into the core analysis system 34, the speed of the displacement, whether the core is collapsing in the inner barrel 62 (indicated, for example, by more displacement at a lower set 80 as compared to at an upper set 80 of resistivity measurements), whether the core is jammed or otherwise not displacing in the inner barrel (indicated, for example, by an absence of change in the resistivity measurements), etc.

By providing longitudinally spaced apart resistivity measurements of the formation 22 external to the core analysis system 34, the rate of penetration of the coring bit 38 into the formation can be determined, the speed of displacement of the coring bit into the formation can be compared to the speed of displacement of the core 40 into the inner barrel 62, etc. It will be appreciated that, if the core 40 is properly displacing into the inner barrel 62, the speed of such displacement will be substantially the same as the speed of displacement of the coring bit 38 through the formation 22. Any significant difference between these speeds can be flagged, made the subject of an alert transmitted to an operator, etc.

Figure 4:
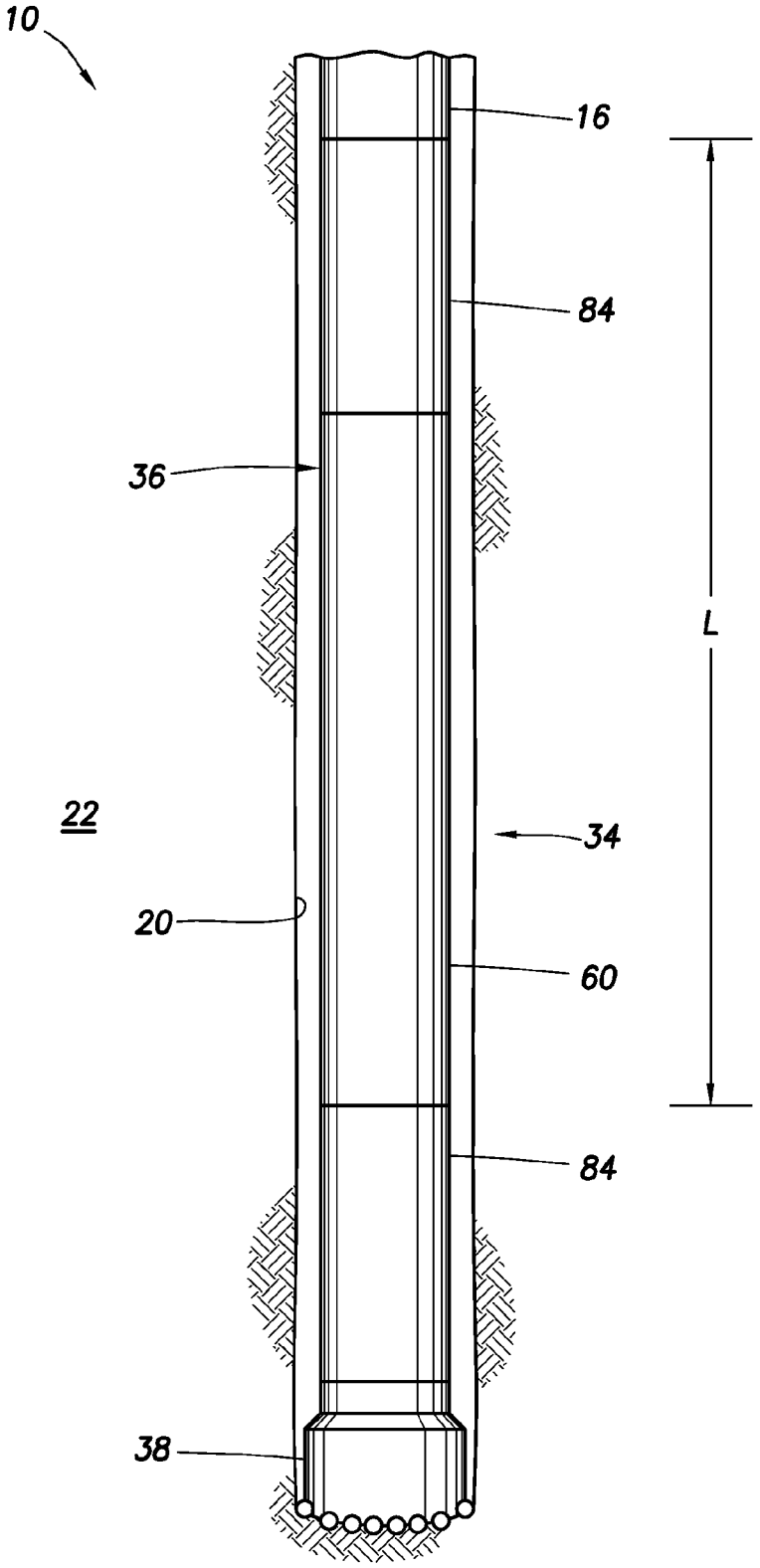
FIG. 4 is a representative cross-sectional view of another configuration of the formation core analysis system.

Referring additionally now to FIG. 4, another configuration of the core analysis system 34 is representatively illustrated. In this configuration, multiple instrumented sections 84 are interconnected longitudinally spaced apart in the outer barrel 62 assembly.

Each instrumented section 84 could include multiple sets 80, 82 of receivers 66, 68 and transmitters 70, 72 (e.g., as in the FIG. 3 example). Alternatively, each instrumented section 84 could include one set of receivers 66, 68 and transmitters 70, 72 (e.g., as in the FIG. 2 example).

Although two instrumented sections 84 are depicted in FIG. 4, with one located near the coring bit 38 and another located near the drill string 16, other numbers of instrumented sections and other locations for the instrumented sections may be used, in keeping with the scope of this disclosure.

Each instrumented section 84 may include its own controller 76 and/or transmitter 78 to transmit data to the telemetry module 32. Alternatively, multiple instrumented sections 84 may share a controller 76 and/or transmitter 78.

In some examples, the resistivity measurements from a single instrumented section 84 may be sufficient to indicate whether there is continuous movement of the core 40 into the core analysis system 34 during the coring operation. Assuming some variations in the resistivity measurements along the core 40, by cross correlating the measurements from two longitudinal locations, the speed of the core into the inner barrel 62 can be continuously determined (velocity=displacement/time) in real time. Using multiple instrumented sections 84 (e.g., as in the configuration of FIG. 4), the displacement of the core 40 in the inner barrel 62 can be monitored at separate locations along the core barrel assembly 36.

In other examples, monitoring of the coring operation can be enhanced by cross correlating the longitudinally spaced apart formation 22 resistivity measurements, as well. In this manner, the speed of the core 40 displacement into the core analysis system 34 can be compared to the speed of penetration of the coring bit 38 into the formation 22.

In another method, measurements from the axially spaced apart transmitters 70, 72 and receivers 66, 68 may be used to evaluate the invasion characteristics of the formation 22. For example, when the formation 22 is drilled into, it is exposed to the drilling fluid 42 in the borehole 20. The drilling fluid 42 in the borehole 20 is typically at a higher pressure than fluid in the formation 22 for purposes of well control. The drilling fluid 42 permeates into the formation 22 and causes subsequent logging measurements to be corrected for the invasion of the drilling fluid into the formation (which causes a change in resistivity, density, etc.).

However, during coring operations, the core 40 is substantially isolated from the drilling fluid 42 as the core travels up the inner barrel 62. By comparing the core 40 resistivity (as measured using the receiver(s) 68 and transmitter(s) 72) to the formation 22 resistivity external to the core analysis system 34 (as measured using the receiver(s) 66 and transmitter(s) 70), the invasion properties of the formation (e.g., the extent of infiltration of the drilling fluid 42 into the formation, etc.) can be determined.

Figure 5:
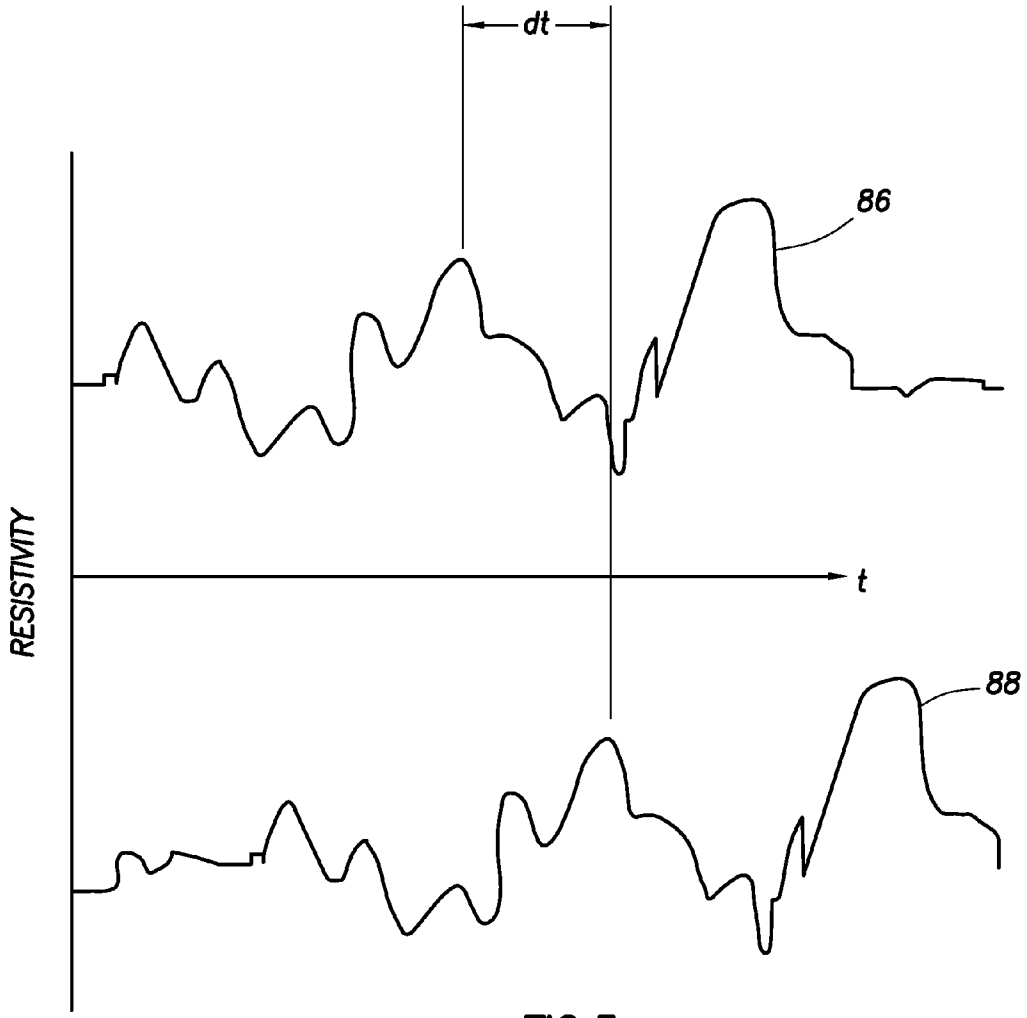
FIG. 5 is a representative graph of core resistivity over time for spaced apart receivers in the formation core analysis system.

Referring additionally now to FIG. 5, an example of how measurements made by the receivers 68 and transmitters 72 can be used to determine a speed of displacement of the core 40 into the inner barrel 62 while the core is being cut is representatively illustrated. In this example, graphs 86, 88 are depicted of resistivity measurements over time (resistivity along the vertical axis, and time along the horizontal axis).

The graph 86 measurements are taken by a lower receiver 68, and the graph 88 measurements are taken by an upper receiver 68. Note that the graphs 86, 88 are correlated by a delay time dt between the two graphs. The speed of the displacement of the core 40 into the inner barrel 62 in this example is equal to the longitudinal distance L between the receivers 68 (see FIGS. 3 & 4) divided by the delay time dt.

Although the graphs 86, 88 are for resistivity over time, it is not necessary for the measurement data transmitted from the receivers 68 to include resistivity measurements. In some examples, the measurement data may include measurements of parameters (such as voltage, current, phase, etc.) from which the resistivity of the core 40 can be derived.

Similarly, using the measurements made by the receivers 66, the speed of the coring bit's 38 penetration into the formation 22 can be determined. As discussed above, valuable insights into the coring operation (such as, whether the core 40 is jammed in the inner barrel 62, whether the core is being continuously received into the core analysis system 34, etc.) can be obtained from comparing the speeds of the core and of the coring bit 38.

Figure 6:
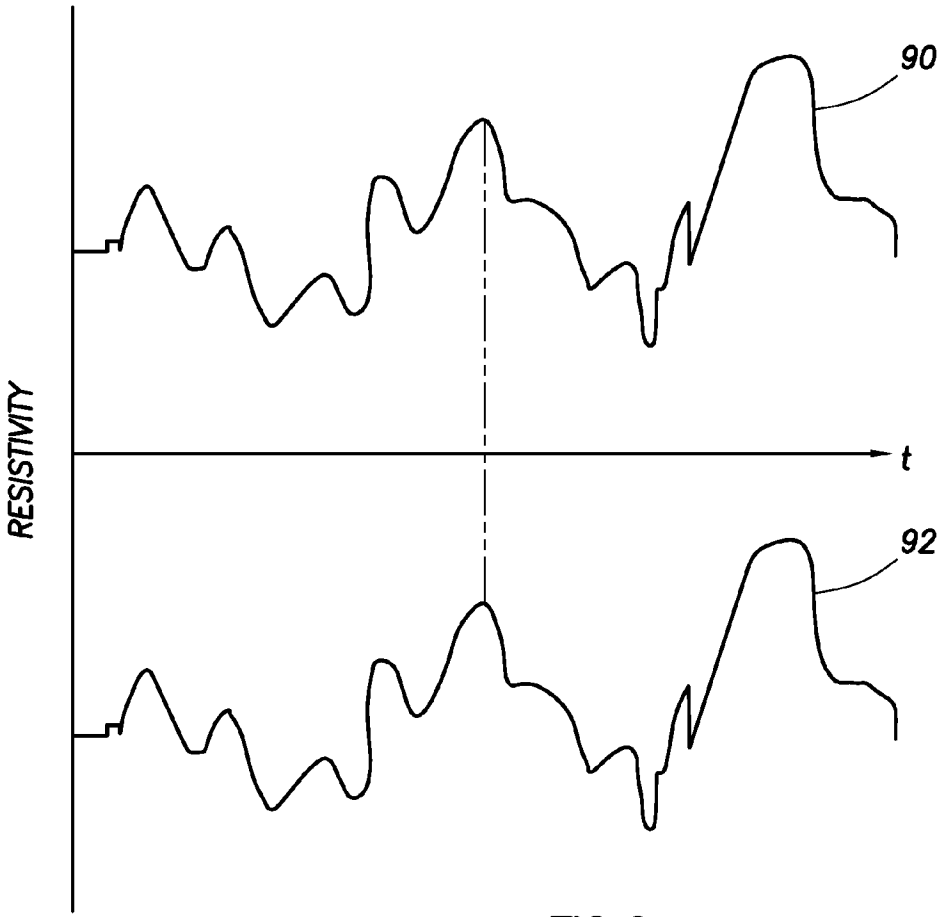
FIG. 6 is a representative graph of internal and external resistivity over time measured by receivers in the formation core analysis system.

Referring additionally now to FIG. 6, an example of how measurements taken by the receivers 66, 68 can be compared, in order to provide for monitoring of the coring operation, is representatively illustrated. In this example, graphs 90, 92 are depicted of resistivity measurements taken by the respective receivers 66, 68 over time (resistivity along the vertical axis, and time along the horizontal axis).

Note that, as depicted in FIG. 6, the graphs 90, 92 are substantially correlated in time (accounting for any longitudinal offset between the receivers 66, 68). In the FIG. 2 example, the receivers 66, 68 are longitudinally offset, but the receivers are not longitudinally offset in the FIG. 3 example.

Since the graphs 90, 92 do not vary from each other significantly over time in the FIG. 6 example, it can be concluded that the core 40 is displacing into the inner barrel 62 of the core barrel assembly 36 at substantially the same speed as the coring bit 38 is cutting into the formation 22. If the core 40 resistivity measurements were lagging behind the formation 22 resistivity measurements, this would be an indication that the core is beginning to jam in the core barrel assembly 36 or coring bit 38, or the core is beginning to compact or collapse in the inner barrel 62. The resistivity measurements from the spaced apart sets 80 of receivers 68 and transmitters 72 can be used to determine whether such compaction or collapsing is occurring (which would be indicated by a greater speed at a lower set than at an upper set), or whether the core 40 is not properly displacing into the inner barrel 62 (which would be indicated by the same, reduced speed at the upper and lower sets).

It may now be fully appreciated that this disclosure provides significant benefits to the art of monitoring core cutting operations. In examples described above, displacement of the core 40 into the core barrel assembly 36 can be conveniently monitored, and the displacement of the core can be readily compared to displacement of the coring bit 38 into the formation 22.

A method of monitoring a formation core 40 during coring operations is provided to the art by this disclosure. In one example, the method can include measuring resistivities of a formation 22 internal and external to a core barrel assembly 36; comparing the resistivities of the formation 22 internal and external to the core barrel assembly 36; and determining a displacement of the core 40 into the core barrel assembly 36, based at least in part on the comparing, while the core 40 is being cut.

Determining the displacement of the core 40 can include determining a speed of the core 40 displacement into the core barrel assembly 36, determining that the core 40 is not displacing into the core barrel assembly 36, and/or determining that the core 40 is collapsing in the core barrel assembly 36.

The measuring step can include transmitting electromagnetic waves 64, 74 into the formation 22 and/or into the core 40.

The transmitting step can include transmitting the electromagnetic waves 74 from an electromagnetic wave transmitter 70 positioned in a coring bit 38, transmitting the electromagnetic waves 64 through a material of an inner barrel 62 of the core barrel assembly 36, rotating at least one electromagnetic wave transmitter 70 relative to the formation 22, and/or rotating at least one electromagnetic wave transmitter 72 relative to an inner barrel 62 of the core barrel assembly 36.

The measuring step can also include receiving the electromagnetic waves 64, 74 at an electromagnetic wave receiver 66, 68 positioned in a coring bit 38.

The measuring step can include measuring the resistivities with longitudinally spaced apart sets 80, 82 of transmitters 70, 72 and receivers 66, 68. The determining step can include determining relative displacements of the coring bit 38 and the core 40, respectively, based on comparing the resistivities measured by the longitudinally spaced apart sets 80, 82 of transmitters 70, 72 and receivers 66, 68. A velocity of the displacement of the core 40 into the core barrel assembly 36 is indicated by differences between measurements taken via the longitudinally spaced apart sets 80, 82 of transmitters 70, 72 and receivers 66, 68 as the core 40 displaces into the core barrel assembly 36.

The method can include determining displacement of a coring bit 38 into the formation 22 based at least in part on the comparing.

The method can include comparing a speed of the displacement of the core 40 to a speed of the displacement of the coring bit 38.

The method can include providing an alert in response to a significant difference between a speed of the displacement of the core 40 and a speed of the displacement of the coring bit 38.

Also described above is a formation core 40 analysis method. The method can, in one example, include measuring resistivity of a formation core 40 while the core 40 displaces into a core barrel assembly 36, the measuring being performed with multiple longitudinally spaced apart first sets 80 of transmitters 72 and receivers 68; measuring resistivity of a formation 22 external to the core barrel assembly 36 while a coring bit 38 penetrates the formation 22, the measuring being performed with multiple longitudinally spaced apart second sets 82 of transmitters 70 and receivers 66; and determining a speed of displacement of the core 40 into the core barrel assembly 36, based at least in part on differences between measurements taken via the first and second sets 80, 82 of transmitters 70, 72 and receivers 66, 68 as the core 40 displaces into the core barrel assembly 36.

A speed of displacement of the coring bit 38 into the formation 22 may be indicated by differences between measurements taken via the second sets 82 of transmitters 70 and receivers 66 as the coring bit 38 penetrates the formation 22.

A collapse of the core 40 may be indicated by a difference between the speed of displacement of the core 40 and the speed of displacement of the coring bit 38.

The transmitters 72 of the first sets 80 may transmit electromagnetic waves 64 into the core 40. The transmitters 70 of the second sets 82 may transmit electromagnetic waves 74 into the formation 22 external to the core barrel assembly 36.

A formation core analysis system 34 described above can, in one example, include multiple longitudinally spaced apart first sets 80 of transmitters 72 and receivers 68 which measure resistivity of a core 40 while the core 40 displaces into a core barrel assembly 36, multiple longitudinally spaced apart second sets 82 of transmitters 70 and receivers 66 which measure resistivity of a formation 22 external to the core barrel assembly 36 while a coring bit 38 penetrates the formation 22, and wherein a speed of displacement of the core 40 into the core barrel assembly 36 is indicated by differences in time between measurements taken via the first and second sets 80, 82 of transmitters 70, 72 and receivers 66, 68 as the core 40 displaces into the core barrel assembly 36.

A method of determining a speed of displacement of a formation core 40 into a core barrel assembly 36 as the core 40 is being cut can include measuring resistivity of the core 40 by transmitting electromagnetic waves 64 into the core 40 as the core 40 is being cut; measuring resistivity of a formation 22 external to the core barrel assembly 36 by transmitting electromagnetic waves 74 into the formation 22 as the formation 22 is being cut by a coring bit 38; and determining the speed of displacement of the core 40 into the core barrel assembly 36 relative to a speed of displacement of the coring bit 38 into the formation 22, based at least in part on differences between the measured resistivities of the core 40 and the formation 22.

Transmitting the electromagnetic waves 64 into the core 40 can include transmitting the electromagnetic waves 64 from an electromagnetic wave transmitter 72 positioned in the coring bit 38. Measuring the resistivity of the core 40 can include receiving the electromagnetic waves 64 by an electromagnetic wave receiver 68 positioned in the coring bit 38.

Measuring the resistivity of the core 40 may include measuring the resistivity with longitudinally spaced apart sets 80 of transmitters 72 and receivers 68. Each set 80 can comprise at least one of the transmitters 72 and at least one of the receivers 68.

The determining step can include determining relative displacements of the coring bit 38 and the core 40, respectively, based at least in part on comparing the resistivities measured by the longitudinally spaced apart sets 80 of transmitters 72 and receivers 68.

The speed of the displacement of the core 40 may be indicated by differences between measurements taken via the longitudinally spaced apart sets 80 of transmitters 72 and receivers 68 as the core 40 displaces into the core barrel assembly 36.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of monitoring a formation core during coring operations, the method comprising:

measuring resistivities of a formation internal and external to a core barrel assembly with longitudinally spaced apart sets of transmitters and receivers;

comparing the resistivities of the formation internal and external to the core barrel assembly; and determining a displacement of the core into the core barrel assembly, based at least in part on the comparing, while the core is being cut, wherein the determining further comprises determining relative displacements of the coring bit and the core, respectively, based on comparing the resistivities measured by the longitudinally spaced apart sets of transmitters and receivers.

2. The method of claim 1, wherein the determining further comprises determining a speed of the core displacement into the core barrel assembly.

3. The method of claim 1, wherein the determining further comprises determining that the core is not displacing into the core barrel assembly.

4. The method of claim 1, wherein the determining further comprises determining that the core is collapsing in the core barrel assembly.

5. The method of claim 1, wherein the measuring comprises transmitting electromagnetic waves into the formation.

6. The method of claim 5, wherein the measuring comprises transmitting electromagnetic waves into the core.

7. The method of claim 5, wherein the transmitting further comprises transmitting the electromagnetic waves from an electromagnetic wave transmitter positioned in a coring bit.

8. The method of claim 5, wherein the measuring further comprises receiving the electromagnetic waves at an electromagnetic wave receiver positioned in a coring bit.

9. The method of claim 5, wherein the transmitting further comprises transmitting the electromagnetic waves through a material of an inner barrel of the core barrel assembly.

10. The method of claim 5, wherein the transmitting further comprises rotating at least one electromagnetic wave transmitter relative to the formation.

11. The method of claim 5, wherein the transmitting further comprises rotating at least one electromagnetic wave transmitter relative to an inner barrel of the core barrel assembly.

12. The method of claim 1, wherein a velocity of the displacement of the core into the core barrel assembly is indicated by differences between measurements taken via the longitudinally spaced apart sets of transmitters and receivers as the core displaces into the core barrel assembly.

13. The method of claim 1, further comprising determining displacement of a coring bit into the formation based at least in part on the comparing.

14. The method of claim 13, further comprising comparing a speed of the displacement of the core to a speed of the displacement of the coring bit.

15. The method of claim 13, further comprising providing an alert in response to a significant difference between a speed of the displacement of the core and a speed of the displacement of the coring bit.

16. A formation core analysis method, comprising:

measuring resistivity of a formation core while the core displaces into a core barrel assembly, the measuring being performed with multiple longitudinally spaced apart first sets of transmitters and receivers;

measuring resistivity of a formation external to the core barrel assembly while a coring bit penetrates the formation, the measuring being performed with multiple longitudinally spaced apart second sets of transmitters and receivers, wherein a speed of displacement of the coring bit into the formation is indicated by differences between measurements taken via the second sets of transmitters and receivers as the coring bit penetrates the formation; and determining a speed of displacement of the core into the core barrel assembly, based at least in part on differences between measurements taken via the first and second sets of transmitters and receivers as the core displaces into the core barrel assembly, wherein a collapse of the core is indicated by a difference between the speed of displacement of the core and the speed of displacement of the coring bit.

17. The method of claim 16, wherein the transmitters of the first sets transmit electromagnetic waves into the core.

18. The method of claim 17, wherein the transmitters of the second sets transmit electromagnetic waves into the formation external to the core barrel assembly.

19. A formation core analysis system, comprising:

multiple longitudinally spaced apart first sets of transmitters and receivers which measure resistivity of a formation core while the core displaces into a core barrel assembly;

multiple longitudinally spaced apart second sets of transmitters and receivers which measure resistivity of a formation external to the core barrel assembly while a coring bit penetrates the formation, and wherein a speed of displacement of the core into the core barrel assembly is indicated by differences in time between measurements taken via the first and second sets of transmitters and receivers as the core displaces into the core barrel assembly, wherein a speed of displacement of the coring bit into the formation is indicated by differences in time between measurements taken via the second sets of transmitters and receivers as the coring bit penetrates the formation, and wherein a collapse of the core is indicated by a difference between the speed of displacement of the core and the speed of displacement of the coring bit.

20. The system of claim 19, wherein the transmitters of the first sets transmit electromagnetic waves into the core.

21. The system of claim 20, wherein the transmitters of the second sets transmit electromagnetic waves into the formation external to the core barrel assembly.

22. A method of determining a speed of displacement of a formation core into a core barrel assembly as the core is being cut, the method comprising:

transmitting electromagnetic waves into the core as the core is being cut and measuring the resistivity of the core with longitudinally spaced apart sets of transmitters and receivers;

measuring resistivity of a formation external to the core barrel assembly by transmitting electromagnetic waves into the formation as the formation is being cut by a coring bit;

comparing the resistivities measured by the longitudinally spaced apart sets of transmitters and receivers; and determining the speed of displacement of the core into the core barrel assembly relative to a speed of displacement of the coring bit into the formation, based at least in part on the comparing.

23. The method of claim 22, wherein the transmitting electromagnetic waves into the core further comprises transmitting the electromagnetic waves from an electromagnetic wave transmitter positioned in the coring bit.

24. The method of claim 22, wherein the measuring the resistivity of the core further comprises receiving the electromagnetic waves by an electromagnetic wave receiver positioned in the coring bit.

25. The method of claim 22, wherein each set comprises at least one of the transmitters and at least one of the receivers.

26. The method of claim 22, wherein the speed of the displacement of the core is indicated by differences between measurements taken via the longitudinally spaced apart sets of transmitters and receivers as the core displaces into the core barrel assembly.

27. The method of claim 22, further comprising providing an alert in response to a significant difference between the speed of the displacement of the core and the speed of the displacement of the coring bit.

28. The method of claim 22, wherein the determining further comprises determining that the core is not displacing into the core analysis system.

29. The method of claim 22, wherein the determining further comprises determining that the core is collapsing in the core barrel assembly.

30. The method of claim 22, wherein the transmitting the electromagnetic waves into the core further comprises transmitting the electromagnetic waves through a material of an inner barrel of the core barrel assembly.

31. The method of claim 22, wherein the transmitting the electromagnetic waves into the formation further comprises rotating at least one electromagnetic wave transmitter relative to the formation.

32. The method of claim 22, wherein the transmitting the electromagnetic waves into the core further comprises rotating at least one electromagnetic wave transmitter relative to the core.

33. The method of claim 22, wherein the transmitting the electromagnetic waves into the core further comprises rotating at least one electromagnetic wave transmitter relative to an inner barrel of the core barrel assembly.

* * * * *